US007163374B2

(12) United States Patent
Lee et al.

(10) Patent No.: US 7,163,374 B2
(45) Date of Patent: Jan. 16, 2007

(54) BLOWER FAN STRUCTURE

(75) Inventors: Jung Woo Lee, Seoul (KR); Moon Kee Chung, Seoul (KR); Sim Won Chin, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 10/943,102

(22) Filed: Sep. 17, 2004

(65) Prior Publication Data

US 2005/0186077 A1 Aug. 25, 2005

(30) Foreign Application Priority Data

Feb. 25, 2004 (KR) ..... 10-2004-0012685

(51) Int. Cl.
*F04D 29/28* (2006.01)

(52) U.S. Cl. ..... 416/186 R; 416/228

(58) Field of Classification Search ..... 416/186 R, 416/187–189, 228, 243
See application file for complete search history.

(56) References Cited

U.S. PATENT DOCUMENTS 3,668,887 A * 6/1972 Riello ..... 62/262
4,362,468 A * 12/1982 Nishikawa et al. ..... 416/186 R
4,647,271 A * 3/1987 Nagai et al. ..... 416/186 R
6,769,876 B1 * 8/2004 Sakai et al. ..... 416/187

OTHER PUBLICATIONS

U.S. Appl. No. 10/929,493, to Moon Kee Chung, which was filed Aug. 31, 2004.
U.S. Appl. No. 10/943,007, to Jung Woo Lee et al., which was filed Sep. 17, 2004.

* cited by examiner

*Primary Examiner*—Ninh H. Nguyen
(74) *Attorney, Agent, or Firm*—Greenblum & Bernstein, P.L.C.

(57) ABSTRACT

Provided is an improved blower fan structure in which length of blades is increased and inlet and outlet angles of the blades are optimized for highly increasing an efficiency of the blower fan. Particularly, an outer diameter of the blades is more than or equal to two times of an inner diameter thereof, for increasing the efficiency without generating a noise.

21 Claims, 6 Drawing Sheets

BLOWER FAN STRUCTURE

BACKGROUND OF THE INVENTION

1. Field of the Invention

The present invention relates to a blower fan, and more particularly, to a blower fan having an improved structure to increase an efficiency of the blower fan and miniaturize the blower fan. Particularly, the present invention is directed to a blower fan in which the number and shape of blades thereof are optimized to increase a blast capacity and thereby miniaturize the blower fan.

2. Description of the Related Art

Blower fans are used to suck and blow a large amount of air. Among the blower fans, the present invention is focused on turbo fans, which suck air in an axial direction and blow the air in a radial direction, while changing a flow direction of the air by 90 degrees with blades.

Generally, a blower fan includes a shroud formed in a direction of an air inlet, a hub formed in a direction of an air outlet, and a plurality of blades fixed to the shroud and the hub.

Meanwhile, the blower fan of the related art has a large $D_1/D_2$ ratio, where $D_1$ is an inner diameter and $D_2$ is an outer diameter of blades, such that the related art blower fan has an large size and as a result, an indoor unit of an air conditioner in which the blower fan is to be installed is also enlarged.

Further, to improve static pressure properties of the blower fan, the blades of the blower fan are inclined in a direction of rotation of the blower fan. However, an air flowing along the blades during rotation of the blower fan is subjected to more pneumatic resistance owing to the inclination of the blades, such that an efficiency of the blower fan is lowered. Consequently, when the blower fan is used, the blower fan must be driven at a high speed to blow a required amount of air because of the lower efficiency, thereby consuming more power.

SUMMARY OF THE INVENTION

Accordingly, the present invention is directed to a blower fan structure that substantially obviates one or more problems due to limitations and disadvantages of the related art.

An object of the present invention is to provide a blower fan structure that has optimized design factors, such as an inner and outer diameter ratio (D1/D2 ratio) of blades, inlet angles and outlet angles of the blades, and the number of the blades, for a miniaturization and high efficiency of a blower fan.

Another object of the present invention is to provide an optimized blower fan structure that has increased static pressure properties and a static efficiency, through a number of experiments.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a blower fan structure includes: a shroud; a hub for guiding airflow being discharged; and a plurality of blades formed between the shroud and the hub and having an inner/outer diameter ratio D1/D2 of 0.5 or less, wherein the inner diameter D1 is a diameter of a circle formed by the innermost points of the blades and the outer diameter is a diameter of a circle formed by the outermost points of the blades.

In another aspect of the present invention, a blower fan structure includes: a shroud; a hub for guiding airflow being discharged; and a plurality of blades formed between the shroud and the hub, and having an inlet angle ranging from 22 degrees to 28 degrees.

In a further another aspect of the present invention, a blower fan structure includes: a shroud formed in a direction of an air inlet; a hub for guiding airflow being discharged; and a plurality of blades formed between the shroud and the hub, and having an outlet angle ranging from 45 degrees to 55 degrees.

Since a blower fan has an optimized structure according to the present invention, the blower fan can have an increased efficiency and blow a necessary amount of air while reducing its size.

Further, the blower fan structure of the present invention can reduce a noise during operation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

The spirits of the present invention can be exactly understood with reference to the descriptions of the embodiments and the accompanying drawings. Further, though a turbo fan is described as an embodiment, the present invention is not limited to the turbo fan and it will be apparent to those skilled in the art that the present invention is employed in different kind of fans.

Figure 1:
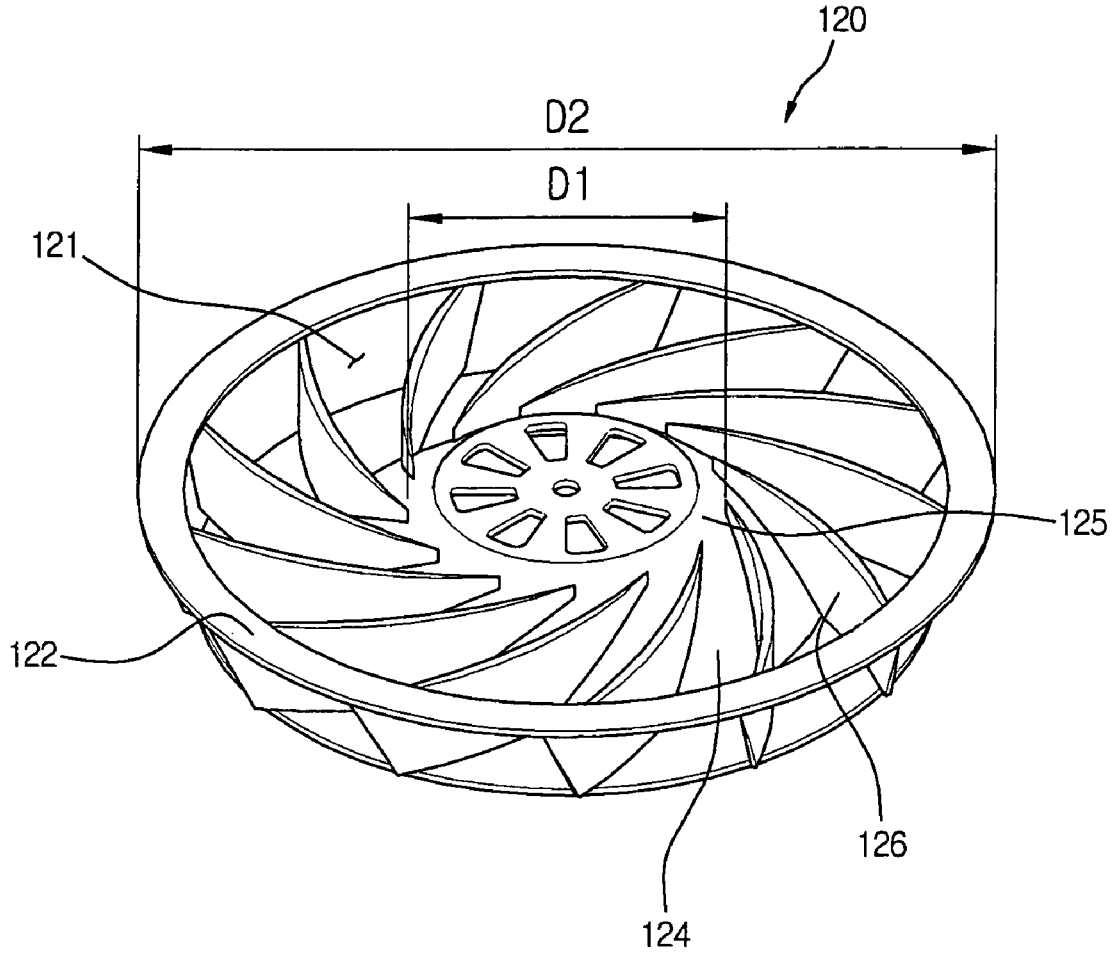
FIG. 1 is a perspective view of a blower fan of the present invention.
Figure 2:
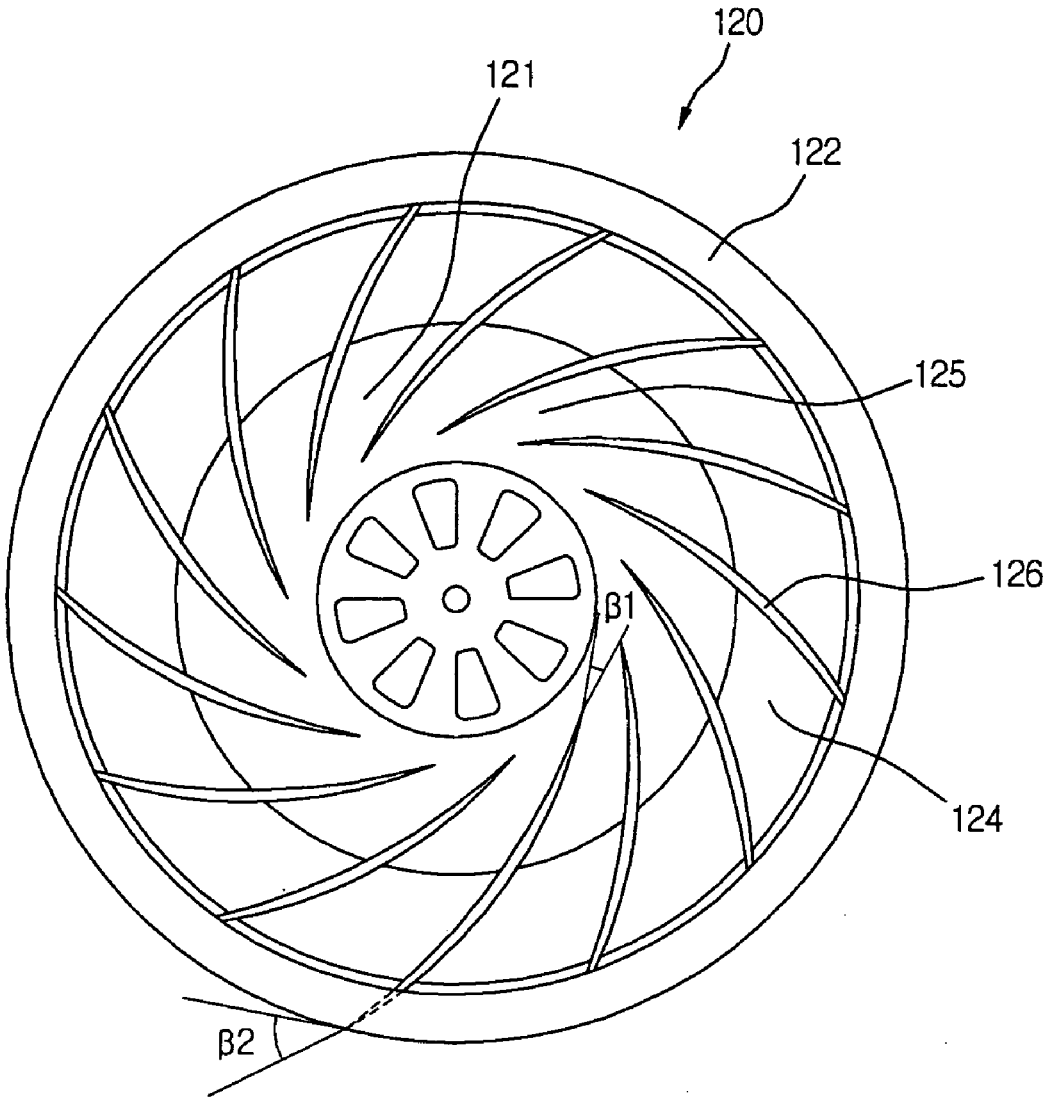
FIG. 2 is a plan view of a blower fan of the present invention.

FIG. 1 is a perspective view of a blower fan of the present invention and FIG. 2 is a plan view of a blower fan of the present invention.

Referring to FIGS. 1 and 2, a blower fan 120 of the present invention includes a shroud 122 provided at a central portion with an inlet 121, for sucking an air therethrough, a hub 124 disposed facing the shroud 122 with spacing a predetermined distance therebetween, and a plurality of blades 126 uniformly disposed between the shroud 122 and the hub 124, for forcibly blowing an air from the inlet 121 of the shroud 122 in a radial direction of the blower fan 120.

The shroud 122 is ring-shaped at a front and relatively bigger than the hub 124. A bell mouse can be additionally disposed on the front, for smoothly guiding a sucking airflow.

The hub 124 is cylindrically shaped as a whole and installed at a position facing the shroud 122. The hub 124 is provided at a central portion with an elevated portion 125 projecting toward the shroud 122 in a front direction, for changing a direction of airflow from the front air inlet 121 direction to a radial air outlet direction while reducing a pneumatic resistance. The elevated portion 125 is provided therein with a motor, and a shaft of the motor is inserted in a shaft hole formed at a center of the elevated portion 125.

The plurality of blades 126 are formed between the shroud 122 and the hub 124 and inner ends of the blades 126 have a curvature. Herein, the plurality of blades 126 have the same outer diameter as the shroud 122 at its portion close to the shroud 122, and the outer diameter measured at the portion close to the shroud 122 is bigger than another outer diameter measure at another portion close to the hub 124. That is, the outer diameter of the plurality of blades 126 at the portion close to the hub 124 is smaller than that at the portion close to the shroud 122, for reducing a pneumatic resistance during the blower fan operation.

Meanwhile, the present invention is provided to increase an efficiency of the blower fan 120. For this purpose, the blower fan 120 of the present invention is optimized in design factors such as an inner/outer diameter ratio (D1/D2 ratio) of the blower fan 120, inlet angles β1 and outlet angles β2 of the blades 126, and the number of blades 126. It will be also found that the blower fan 120 of the present invention has improved static pressure properties and an increased static efficiency owing to the optimized design factors. Hereinafter, the design factors will be described in fully.

Figure 3:
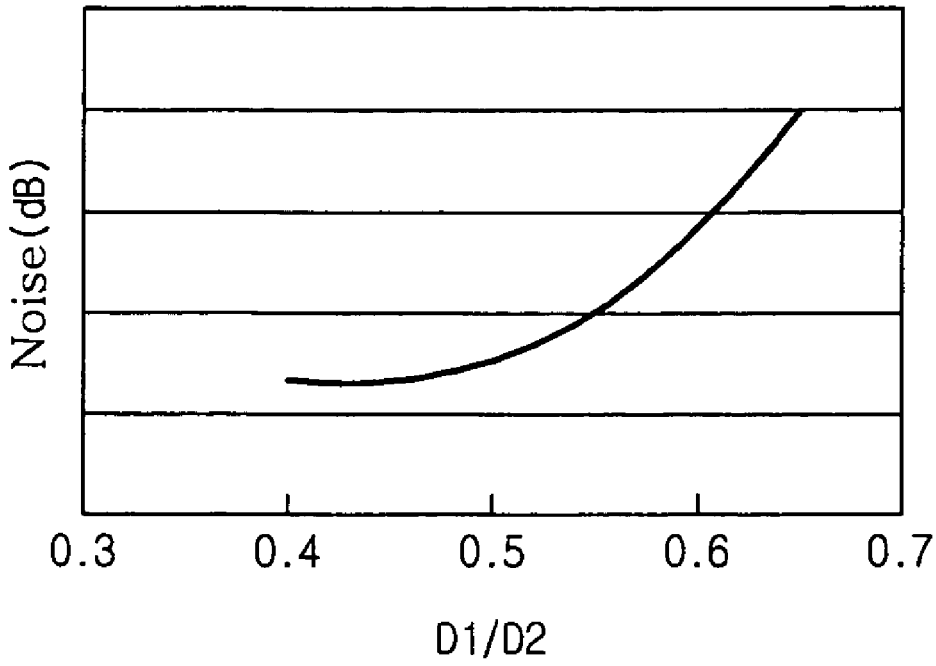
FIG. 3 is a graph illustrating a noise characteristic with respect to an inner/outer diameter ratio of a blower fan according to the present invention.

The D1/D2 ratio is a ratio of the inner diameter (D1) and the outer diameter (D2) of the blades 126 and it is designed to be lower than or equal to 0.5 to increase the efficiency of the blower fan 120. In detail, as the D1/D2 ratio is getting lower, the static pressure properties are increased, such that a blast capacity of the blower fan 120 is increased. Further, if the D1/D2 ratio of the blower fan 120 is getting higher, there is generated more noise such that the D1/D2 ratio is required to be kept low. In case of describing the D1/D2 ratio in terms of the noise, the noise decreases until a certain point according to decrease of the D1/D2 ratio and after the certain point, the decrease of the noise slows down. The relationship between the noise and the D1/D2 ratio is shown in FIG. 3. Therefore, the D1/D2 ratio of the blower fan 120 is limited to a range lower than or equal to 0.5 in order to increase the static pressure properties and the blast capacity of the blower fan 120, without increasing the noise by making the D1/D2 ratio larger than the certain point. In case of limiting the D1/D2 ratio to the range, the blades 126 are to be extended into the elevated portion 125, and lengths of the blades 126 are elongated because the outer diameter of the blades 126 is more than or equal to two times of the inner diameter thereof.

Further, the inlet and outlet angles β1, β2 of the blades 126, another optimal design factor of the blower fan 120, are limited to a range of 22° to 28° and a range of 45° to 55° respectively. The inlet angle β1 of the blades 126 is limited to the range of 22° to 28° because a noise is generated when an air sucked through a suction passage of the blower fan 126 is collided against front edges of the blades 126 and the noise increases when the inlet angle β1 of the blades 126 is larger or lower than 25°. Further, it is observed through experiments that the noise is low when the outlet angle β2 is limited to the range of 45° to 55°. Herein, the inlet angle β1 is an angle included between an imaginary line extended from each inner end of the blades 126 and a tangent line of an imaginary circle formed by the inner ends of the blades 126, and the outlet angle is an angle included between an imaginary line extended from each outer end of the blades 126 and a tangent line of an imaginary circle formed by the outer ends of the blades 126.

The number of blades 126, another optimal design factor of the blower fan 120, is most preferably about eight to about fifteen when the above described design factors, such as the D1/D2 ratio and the inlet and outlet angles β1 and β2, are considered. By forming the blades 126 with the eight to fifteen numbers, the blower fan 120 can be small sized and have a high efficiency (static pressure properties and static efficiency), while minimizing the noise.

A number of experiments are carried out to provide the structure of the blower fan of the invention and the result of the experiments will now be described.

Figure 4:
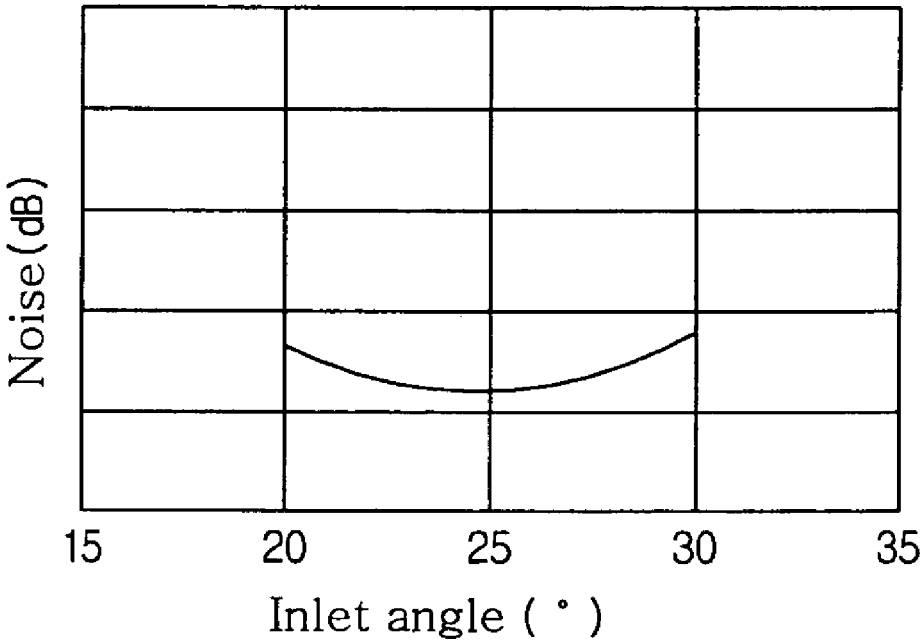
FIG. 4 is a graph illustrating a noise characteristic with respect to an inlet angle of a blower fan according to the present invention.
Figure 5:
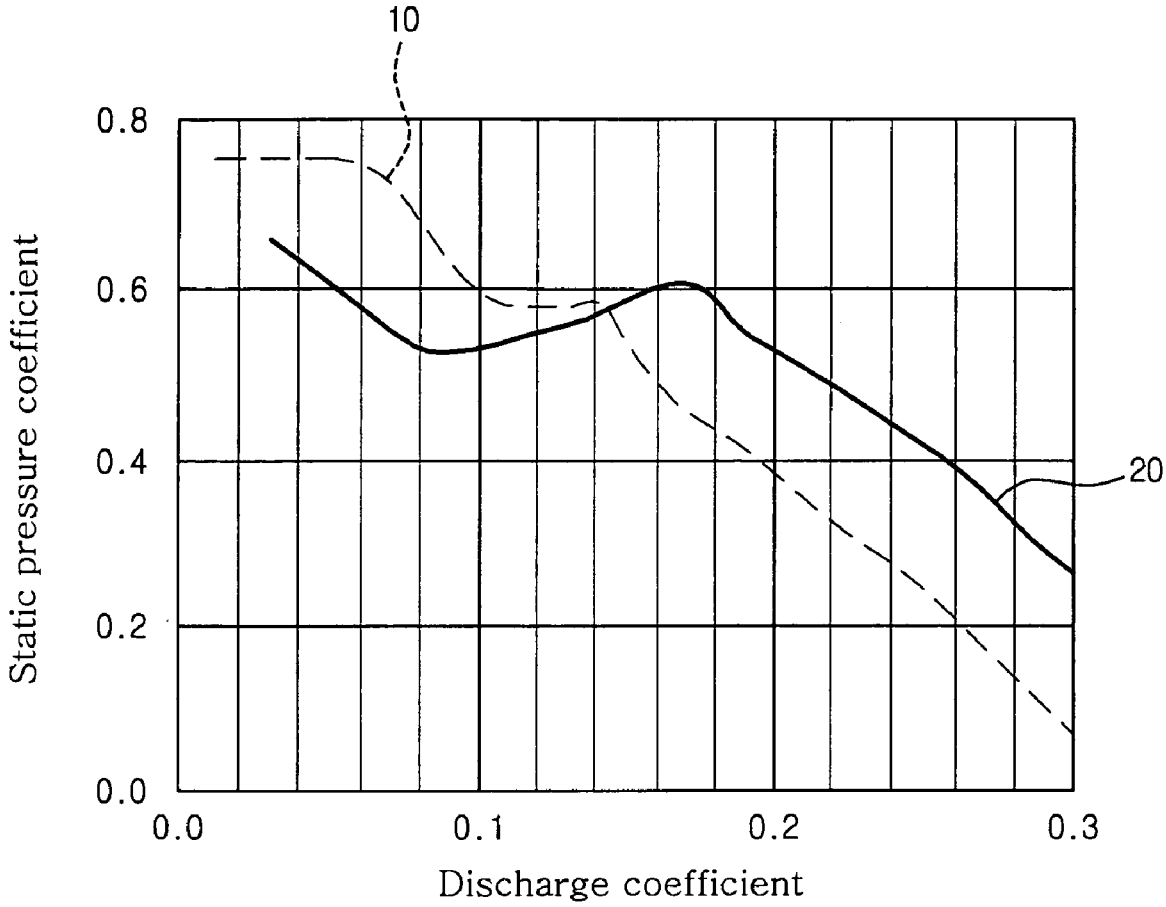
FIG. 5 is a graph illustrating static pressure coefficient curves with respect to discharge coefficient, for comparing a present inventive blower fan with a related art blower fan.
Figure 6:
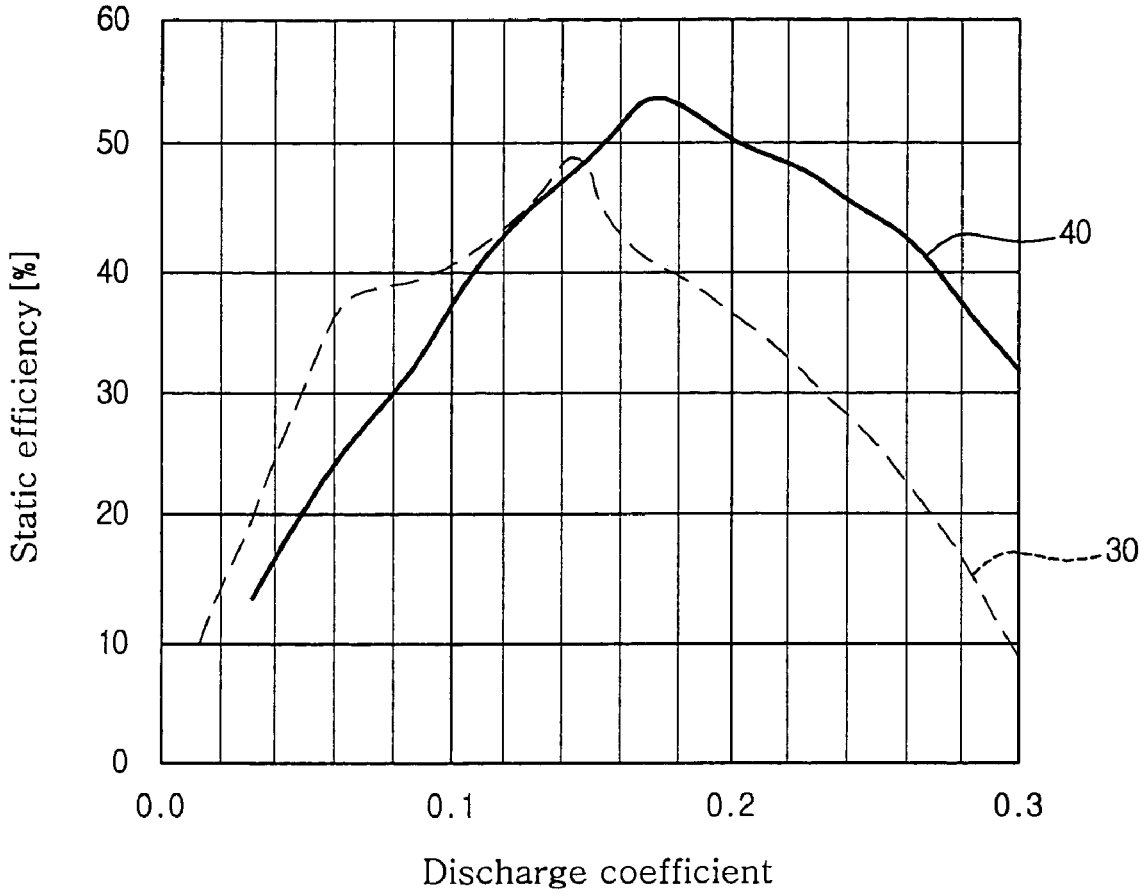
FIG. 6 is a graph illustrating static pressure efficiency curves with respect to discharge coefficient, for comparing a present inventive blower fan with a related art blower fan.

FIG. 3 is a graph illustrating a noise characteristic with respect to a ratio of inner diameter and outer diameter of a blower fan according to the present invention, FIG. 4 is a graph illustrating a noise characteristic with respect to an inlet angle of a blower fan according to the present invention, FIG. 5 is a graph illustrating static pressure coefficient curves with respect to discharge coefficient, for comparing a present inventive blower fan with a related art blower fan, and FIG. 6 is a graph illustrating static pressure efficiency curves with respect to discharge coefficient, for comparing a present inventive blower fan with a related art blower fan.

Referring to FIG. 3, the noise level is increased, as the D1/D2 ratio of the blower fan 120 is getting larger. In other words, the noise level is decreased, as the D1/D2 ratio is getting lower. Herein the decrease of the noise according to the decrease of the D1/D2 ratio is slowed down when the D1/D2 ratio is below a certain point. Further, it can be known that as the D1/D2 ratio is getting lower, the static pressure properties are improved and the blast capacity of the blower fan 120 is increased. Merely, to avoid much noise when the fan 120 is installed in an indoor unit of an air conditioner, the D1/D2 ratio of the blower fan 120 is limited to a range lower than or equal to 0.5.

Referring to FIG. 4, a noise generated from collision between the sucked air and the front edges of the blades 126 is increased in case the inlet angle β1 is lower or higher than 25°. Therefore, the inlet angle β1 of the blades 126 is set to the range of 22° to 28°, such that the efficiency of the blower fan 120 can be increased under less influence of the noise. Further, the outlet angle β2 is limited to the range of 45° to 55°, for increasing the blast capacity while generating less noise. Furthermore, the number of the blades 126 of the blower fan 120 is eight to fifteen, such that the blower fan can be small sized. Preferably, the number of blades 126 is thirteen.

Referring to FIGS. 5 and 6, the blower fan 120 of the present invention has a static pressure coefficient and a static efficiency, which are increased by about 5% compared to that of a related art blower fan. In detail, according to a variation of a discharge coefficient, FIG. 5 illustrates a static pressure coefficient curve 10 of a related art blower fan and a static pressure coefficient curve 20 of the present inventive blower fan 120, for comparing two curves 10 and 20, and FIG. 6 illustrates a static pressure efficiency curve 30 of a related art blower fan and a static pressure efficiency curve 40 of the present inventive blower fan 120, for comparing two curves 30 and 40. As shown in Figs, the static efficiency of the blower fan 120 is increased. Herein, the related art blower fan having a D1/D2 ratio of 0.8 is used for plotting the curves in drawings.

Meanwhile, the blower fan 120 of the present invention can be used in a window-type air conditioner, an outdoor unit/indoor unit integrated air conditioner, and a ceiling embedded air conditioner, for low noise, low power consumption, and increased blast capacity. Hereinafter, a window-type air conditioner installed with the present inventive blower fan 120 will be described.

Figure 7:
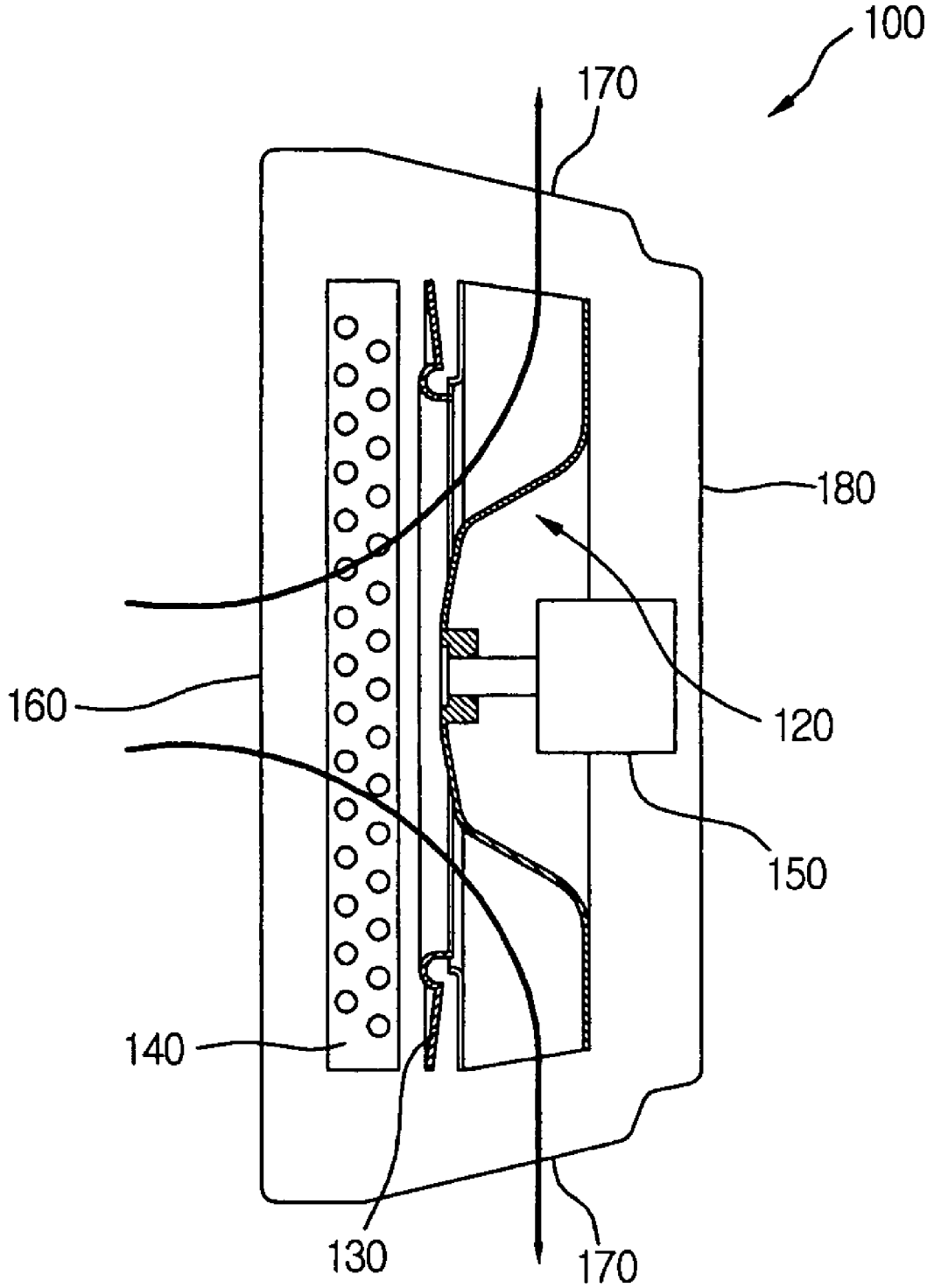
FIG. 7 is a sectional view illustrating a window-type air conditioner adopting a blower fan of the present invention.

FIG. 7 is a sectional view illustrating a window-type air conditioner adopting a blower fan of the present invention.

Referring to FIG. 7, a window-type air conditioner 100 includes: a quadrilateral-shaped case 180; a suction hole 160 formed at a front center portion of the case 180 to provide a passage for sucking an indoor air; the blower fan 120 installed in the case 180 to be rotated for sucking the indoor air into the case 180; a motor 150 rotating the blower fan 120; a bell mouth 130 for guiding the indoor air to the blower fan 120; an evaporator 140 installed between the suction hole 160 and the blower fan 120, for cooling the indoor air through a heat exchange between the indoor air sucked in the case 180 by the blower fan 120 and a refrigerant; discharge holes 170 formed at a lower and an upper portions of the case 180, for discharging the indoor air cooled by an evaporation at the evaporator 140 to the indoor room using the blower fan 120.

An operation of the window-type air conditioner 100 having the above-mentioned structure will now be described. A refrigerant is expanded at an outdoor unit (not shown) into a low-temperature, low-pressure liquid state and the refrigerant liquid flows to the evaporator 140. An indoor air is sucked through the suction hole 160 formed at a center of the window-type air conditioner 100 by the rotation of the blower fan 120. The sucked indoor air is cooled through a heat exchange with the refrigerant flowing in tubes of the evaporator 140 and the cooled air is discharged to the indoor room by the blower fan 120 through the discharge holes 170 formed at the lower and upper outer portions of the case 180. The above-mentioned operation is repeated for cooling the indoor room.

Herein, according to the present invention, a noise generated during the discharge of the cooled air is reduced, such that customers feel more comfortable.

According to the present invention, the blower fan structure of the indoor unit of the air conditioner has optimized design factors such as the D1/D2 ratio, the inlet angles and outlet angles of the blades 126, and the number of blades 126, such that the blower fan can increase the efficiency of the blower fan compared with a blower fan of the related art. Further, the present invention provides the optimized blade design that hardly generate a noise even though it is elongated, such that the blower fan has advantage in terms of size, efficiency, and noise.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A blower fan structures, comprising:

a shroud;

a hub that guides airflow being discharged, an outer periphery of the hub being substantially parallel to the shroud; and a plurality of blades formed between the shroud and the hub, wherein a ratio of a diameter of a circle formed by innermost points of the blades to a diameter of a circle formed by outermost points of the blades is no more than 0.5.

2. The blower fan structure according to claim 1, wherein each of the plurality of blades is shaped such that an outermost point of each blade connecting to the shroud extends further from a center of the hub than an outermost point of each blade connecting to the hub, in order to minimize noise.

3. The blower fan structure according to claim 1, wherein each of the blades has an inlet angle in a range of 22 to 28 degrees.

4. The blower fan structure according to claim 1, wherein each of the blades has an outlet angle in a range of 45 to 55 degrees.

5. The blower fan structure according to claim 1, wherein the a number of the plurality of blades is between eight and fifteen.

6. The blower fan structure according to claim 1, wherein the blades extend to an elevated portion of the hub formed at an approximate center of the hub.

7. The blower fan structure according to claim 1, wherein a bell mouth is provided at a front of the shroud to guide a sucking airflow.

8. The blower fan structure according to claim 1, wherein the shroud has a larger diameter than that of the hub.

9. The blower fan structure according to claim 1, wherein a profile of the shroud is perpendicular to a rotational axis of the blower fan structure.

10. A blower fan structure, comprising:

a shroud, a profile of the shroud being perpendicular to a rotational axis of the blower fan structure;

a hub that guides airflow being discharged, an outer periphery of the hub being substantially parallel to the shroud; and a plurality of blades formed between the shroud and the hub, and having an inlet angle in a range of 22 to 28 degrees.

11. The blower fan structure according to claim 10, wherein each of the blades has an outlet angle in a range of 45 to 55 degrees.

12. The blower fan structure according to claim 10, wherein a diameter of a circle formed by outermost points of the blades is at least equal to a diameter of a circle formed by innermost points of the blades.

13. The blower fan structure according to claim 10, wherein a number of the plurality of blades is thirteen.

14. The blower fan structure according to claim 10, wherein the blades extend to an elevated portion of the hub formed at about a center of the hub.

15. The blower fan structure according to claim 10, wherein an upper end of an outermost end of each blade and a lower end of an outermost end of each blade are located at different distances from a center of the hub.

16. A blower fan structure, comprising:

a shroud formed in a direction of an air inlet, a profile of the shroud being perpendicular to a rotational axis of the blower fan structure;

a hub that guides airflow being discharged, an outer periphery of the hub being substantially parallel to the shroud; and a plurality of blades formed between the shroud and the hub, and having an outlet angle in a range of 45 to 55 degrees.

17. The blowerfan structure according to claim 16, wherein a number of the plurality of blades is between eight and fifteen.

18. The blower fan structure according to claim 16, wherein the blades extend to an elevated portion of the hub formed at an approximate center of the hub.

19. The blower fan structure according to claim 16, wherein a bell mouth is provided at a front of the shroud to guide a sucking airflow.

20. The blower fan structure according to claim 16, wherein the shroud has a larger diameter than that of the hub.

21. The blower fan structure according to claim 16, wherein the hub has an elevated portion formed at an approximate central portion thereof, to which a motor is connected.

* * * * *

UNITED STATES PATENT AND TRADEMARK OFFICE

CERTIFICATE OF CORRECTION

PATENT NO. : 7,163,374 B2
APPLICATION NO. : 10/943102
DATED : January 16, 2007
INVENTOR(S) : J. W. Lee et al.

It is certified that error appears in the above-identified patent and that said Letters Patent is hereby corrected as shown below:

At column 6, line 12 of the printed patent, “structures” should be --structure--.

At column 6, line 36 of the printed patent, before “a” delete “the”.

At column 8, line 1 of the printed patent, “blowerfan” should be --blower fan--.

Signed and Sealed this

Twenty-seventh Day of May, 2008

JON W. DUDAS
*Director of the United States Patent and Trademark Office*